United States Patent [19]

Babitzka et al.

[11] Patent Number: 4,580,540

[45] Date of Patent: Apr. 8, 1986

[54] FUEL INJECTION PUMP FOR INTERNAL COMBUSTION ENGINES

[75] Inventors: Rudolf Babitzka, Kirchberg; Walter Schlagmüller, Schwieberdingen, both of Fed. Rep. of Germany

[73] Assignee: Robert Bosch GmbH, Stuttgart, Fed. Rep. of Germany

[21] Appl. No.: 195,965

[22] Filed: Oct. 10, 1980

[30] Foreign Application Priority Data

Oct. 17, 1979 [DE] Fed. Rep. of Germany ..... 2942010

[51] Int. Cl.[4] ..... F02M 39/00

[52] U.S. Cl. ..... 123/458; 123/459; 123/500

[58] Field of Search ..... 123/338, 458–460, 123/462, 500, 506, 472, 478, 357

[56] References Cited

U.S. PATENT DOCUMENTS

| | | | |
|---|---|---|---|
| 3,319,613 | 5/1967 | Begley et al. | 123/458 |
| 3,661,130 | 5/1972 | Gheim | 123/357 |
| 3,779,225 | 12/1973 | Watson et al. | 123/458 |
| 3,851,635 | 12/1974 | Murtin et al. | 123/458 |
| 3,896,779 | 7/1975 | Omori et al. | 123/458 |
| 4,036,193 | 7/1977 | Kobayashi et al. | 123/357 |

FOREIGN PATENT DOCUMENTS

| | | | |
|---|---|---|---|
| 413475 | 7/1934 | United Kingdom | 123/506 |
| 740178 | 11/1955 | United Kingdom | 123/506 |

*Primary Examiner*—Magdalen Y. C. Moy
*Attorney, Agent, or Firm*—Edwin E. Greigg

[57] ABSTRACT

An electrically controlled fuel injection pump is proposed, in which a portion of the discharger from the pump work chamber is varible by means of an electrically adjustable throttle.

6 Claims, 2 Drawing Figures

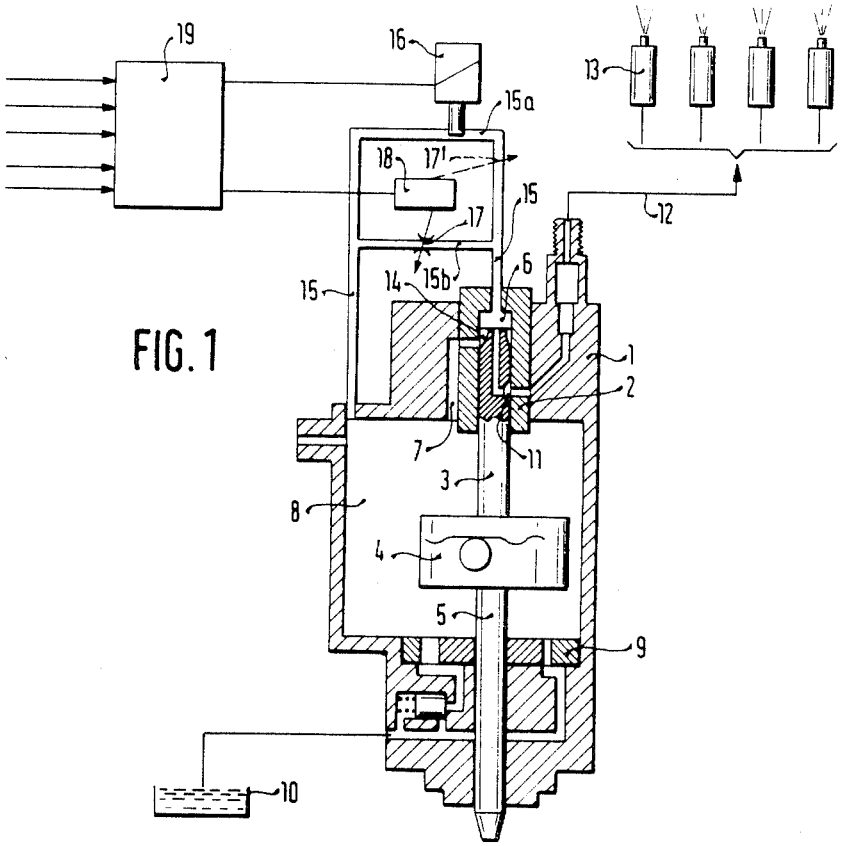
FIG. 1
FIG. 2
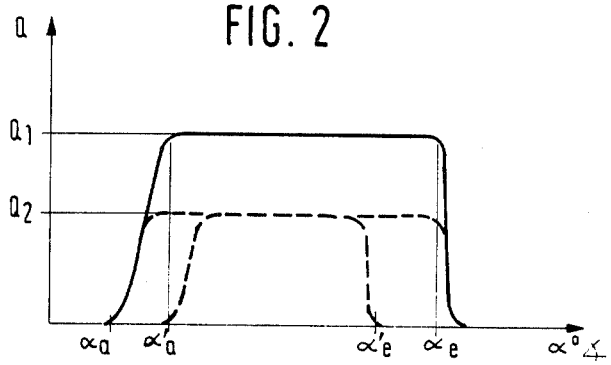

FUEL INJECTION PUMP FOR INTERNAL COMBUSTION ENGINES

BACKGROUND OF THE INVENTION

The invention relates to a fuel injection pump for internal engines. In a known fuel injection pump of this kind, two magnetic valves serve as the electrically actuated control apparatus. One of the magnetic valves controls the fuel flow to the pump work chamber during the intake stroke and the second magnetic valve controls the fuel flow from the pump work chamber to the suction chamber during the compression stroke, thus determining the onset and end of injection. The onset of injection is determined by the onset of the pump work stroke, while the end of injection is determined by the second magnetic valve. The flowthrough quantity of fuel per unit of time is thus identical at all times, so that at high rpm a large quantity over a relatively short time acts as the standard initially, while during idling the small fuel quantity then required flows through the channel in a short time. As is well known, an internal combustion engine is relatively noisy in operation whenever the injection time is very short during idling, as is the case with this known pump. A further disadvantage of this known injection system is that a supplementary apparatus is required for adjusting the onset of injection, such as a hydraulic injection adjuster in the piston drive.

OBJECT AND SUMMARY OF THE INVENTION

The fuel injection pump according to the invention set forth herein has the advantage over the prior art first that the injection onset and the end thereof are controlled arbitrarily, in accordance with the demands of the engine, and second that independently thereof the quantity per unit of time can be determined either by proper adjustment or, again, in accordance with the demands of the engine. Besides having these advantageous functions, this injection system is substantially less expensive to produce and more versatile in its control aspects, so that it can find substantially broader application. The high-pressure pumping element is made up essentially of mass-produced parts. Depending on the embodiment of the invention, the control apparatus and throttle can be combined into one adjusting unit if an element is used which functions rapidly and can be installed in various ways, such as a piezoceramic element.

The invention will be better understood and further objects and advantages thereof will become more apparent from the ensuring detailed description of a preferred embodiment taken in conjunction with the drawings.

BRIEF DESCRIPTION OF THE DRAWINGS

FIG. 1 is a simplified illustration of the principle of the invention; and

FIG. 2 is a diagram illustrating the functioning of the invention.

DESCRIPTION OF THE PREFERRED EMBODIMENT

Disposed in the housing 1 of a fuel injection pump is a sleeve 2 in which a pump piston 3 performs a simultaneously reciprocating and rotating movement. The pump piston 3 is driven by a cam drive 4 via a shaft 5, which rotates in synchronism with the rpm of the engine being supplied with fuel by the injection pump. A pump work chamber 6 is defined by the pump piston 3 and the sleeve 2, communicating via a supply conduit 7 with a suction chamber 8 in the housing 1 of the injection pump. The suction chamber 8 is suppled with fuel from a fuel container 10 via a supply pump 9. From the pump work chamber 6, the fuel is distributed via a longitudinal distributor groove 11 to pressure lines 12 leading to injection nozzles 13 on the engine. In the end area of the pump piston 3, longitudinal grooves 14 are provided which discharge into the end face of the pump piston 3. These longitudinal grooves 14 furnish communication during the intake stroke of the pump piston 3 between the conduits 7 and the pump work chamber 6. Due to the longitudinal grooves in the end of pump piston 3, the fuel is supplied intermittently and the pump piston rotates.

A relief conduit 15 with a controlled cross section branches off from the pump work chamber 6 and discharges into the suction chamber 8. The relief conduit 15, in the illustrated embodiment, branches into the parallel conduits **15*a* and 15*b*, which come together again later to form a single conduit. In conduit 15*a*, there is a magnetic valve 16 by way of which this section can be completely opened or closed. A throttle 17 is disposed in section 15*b* and its cross section is variable by way of an electric final control element 18. The magnetic valve 16 and the final control element 18 are triggerable by an electronic control device 19**, which is supplied with data pertaining to various engine characteristics such as load, rpm, air pressure, temperature, crankshaft angle, and so forth. See for example, German application No. P 26 53 046.1 which corresponds to allowed U.S. patent application Ser. No. 853,669 now U.S. Pat. No. 4,265,200 and assigned to the assignee of the present case.

The onset of injection $\alpha_a$ and the end of injection $\alpha_e$ are determined by the magnetic valve 16. As soon as the magnetic valve 16 closes, a pressure which is sufficient for injection begins to be established in the pump work chamber 6, and injection begins. However, a more or less large quantity of fuel continues to flow through the throttle 17, depending on the cross section, from the pump work chamber 6 even during injection.

In FIG. 2, the fuel quantity injected per degree of crankshaft angle is plotted on the ordinate Q, while the degrees of angle are plotted on the abscissa. At $\alpha_a$, the magnetic valve 16 closes; at $\alpha_e$, it opens once again. The quantity supplied in this angular range is then $Q_1$ (i.e., $\alpha_e-\alpha_a$). Depending on the demands of the engine, for instance if the engine is cold or if there is a change in pressure because of altitude, the injection onset can be shifted to $\alpha'_{a'}$, and/or the end of injection can be shifted to $\alpha'_{e'}$, again via the magnetic valve 16. The injection quantity, in contrast, can be varied by opening the throttle 17 wider, whereupon the fuel quantity per angular degree, thus reduced, drops to the value $Q_2$. Thus, the larger the quantity of fuel to be injected, such as at full load and high rpm, the smaller the throttle cross section of the throttle 17 will be. In like manner, the lower the rpm is intended to be, such as during idling, the smaller the value $Q_2$ will be. If the injection time $\alpha_e-\alpha_a$ is made as long as possible, for instance, then quiet engine operation can be attained at relatively low rpm and a correspondingly small value for $Q_2$.

As indicated by broken lines in the drawing, it is also possible for section **15*b* of the relief conduit to be blocked, and instead of being disposed in parallel as described above, the magnetic valve 16 and the throttle 17 can be disposed one after another. In that event, the throttle 17' would be disposed ahead of the magnetic valve 16. In accordance with a further embodiment of the invention, the control may be effected via a piezoelectric element, which because of its rapid function performs the tasks both of the throttle 17 and of the magnetic valve 16. Depending on the triggering, the single cross section control element disposed in the relief conduit 15** would then close the conduit for injection onset, but only to such an extent as required by the applied voltage, and then open the conduit again for the end of injection. The rapidity of an adjuster of this kind offers the opportunity of varying the momentary flow-through quantity up to the point of high-frequency pressure fluctuations (fuel jet preparation).

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump for supplying fuel intermittently to an internal combustion engine comprising a pump work chamber, at least one pumping device to generate a pressure for fuel injection, a relief conduit, at least one electrically actuated control device in said relief conduit to determine the onset and end of fuel injection and to control fuel flow through said relief conduit of the pump work chamber to a suction chamber, further comprising a throttle means disposed in said relief conduit the cross section of which is electrically adjustable, said throttle means arranged to vary the injection quantity supplied per unit of time.

2. A fuel injection pump as defined by claim 1, characterized in that said control device and said throttle means are switched in parallel.

3. A fuel injection pump as defined by claim 1, characterized in that said control device and said throttle means are switched in series.

4. A fuel injection pump as defined by claim 1, characterized in that said control device and said throttle means are combined into a single control member as a piezo-controlled element.

5. A fuel injection pump as defined by claim 1, characterized in that said pumping device further includes a distributor pump having a simultaneously reciprocating and rotating pump piston arranged to feed fuel sequentially into pressure lines leading to said engine.

6. A fuel injection pump as defined by claim 5, characterized in that a portion of said fuel in said pump work chamber is introduced into said relief conduit.

* * * * *